US006058653A

United States Patent [19]

Slocomb et al.

[11] Patent Number: 6,058,653

[45] **Date of Patent: *May 9, 2000**

[54] PIVOTABLE WINDOW SASH ASSEMBLY

[75] Inventors: Colin L. Slocomb, Wilmington, Del.; Edward J. Subliskey, Mountain Top, Pa.

[73] Assignee: CSB Enterprise, Inc., Wilmington, Del.

[ * ] Notice: This patent is subject to a terminal disclaimer.

[21] Appl. No.: 09/232,613

[22] Filed: Jan. 19, 1999

Related U.S. Application Data

[63] Continuation-in-part of application No. 09/002,716, Jan. 5, 1998, Pat. No. 5,927,013, which is a continuation-in-part of application No. 08/684,082, Jul. 19, 1996, Pat. No. 5,704, 165.

[51] Int. Cl.[7] ..... E05D 15/22

[52] U.S. Cl. ..... 49/181; 49/176

[58] Field of Search ..... 49/161, 176, 181, 49/182, 430, 446

[56] References Cited

U.S. PATENT DOCUMENTS 4,238,907 12/1980 Swan .
4,581,850 4/1986 Simpson .
4,850,735 7/1989 Hansen et al. .
4,896,992 1/1990 Muhlethaler .
4,926,524 5/1990 Owens .
5,069,001 12/1991 Makarowski .
5,104,253 4/1992 Zielinski et al. .
5,371,971 12/1994 Prete .
5,399,045 3/1995 Yoneda et al. .
5,414,960 5/1995 O'Donnell et al. .
5,704,165 1/1998 Slocomb et al. ..... 49/181
5,927,013 7/1999 Slocomb et al. ..... 49/181

*Primary Examiner*—Jerry Redman
*Attorney, Agent, or Firm*—Connolly Bove Lodge Hutz LLP

[57] ABSTRACT

A pivotable window sash assembly includes a pivot bar which engages a balance shoe for holding the sash to a master frame. The shoe has a recess in which a locking member is rotatably mounted. The locking member includes an exposed keyway which is selectively aligned with at least one slot in the shoe located at the recess. The pivot bar has an arm which functions as a key for fitting in the keyway and has at least one projection extending outwardly from the arm for fitting in each slot when the slot and keyway are aligned. The pivot bar has a locking member which snaps into a hole in the sash.

18 Claims, 4 Drawing Sheets

PIVOTABLE WINDOW SASH ASSEMBLY

CROSS-REFERENCE TO RELATED APPLICATION

This application is a continuation in part of application Ser. No. 09/002,716, filed Jan. 5, 1998 now U.S. Pat. No. 5,927,013, which in turn is a continuation in part of Ser. No. 08/684,082, filed Jul. 19, 1996, now U.S. Pat. No. 5,704,165.

BACKGROUND OF INVENTION

Various types of window assemblies exist including a pivotable window sash assembly which includes a tilt window sash mounted to a channeled window frame. In use, the window sash would move up and down and would also be capable of pivoting outwardly with respect to the window frame for access, for example, in cleaning the window. A conventional mechanism for accomplishing these movements is to include a balance shoe which is mounted for slidable movement in a channel in the window frame. A pivot bar is secured to the window sash and is engaged with the balance shoe. In this manner the balance shoe moves in the channel which acts as a track during the up and down movement of the window sash. In one form of balance shoe a freely mounted sleeve is included in the balance shoe with a slot in the sleeve engaged by an arm on the pivot bar. As a result, it is possible to rotate the window sash because of the pivotal connection effected by the sleeve being able to freely pivot within its balance shoe.

Generally, the pivot bar is mounted to the window sash by fasteners, such as screws which would require manipulation of the fasteners in order to effect the mounting. U.S. Pat. No. 5,069,001, for example, discloses a pivotable window sash assembly used for extruded frames and sashes wherein the pivot bar is mounted to the sash by such fasteners.

U.S. Pat. Nos. 4,930,254, 5,069,001 and 5,237,775 reflect various prior art approaches for mounting a pivot bar to a balance shoe and various details of pivotable window sash assemblies.

SUMMARY OF INVENTION

An object of this invention is to provide a pivotable window bar assembly which includes a pivot bar for holding the sash to a master frame.

A further object of this invention is to provide such a pivot bar which may be effectively mounted to a balance shoe to keep the sash tight and to keep the master frame plumb.

A still further object of this invention is to provide a pivotable window sash assembly wherein the pivot bar could be quickly and conveniently mounted to the window sash without the need for manipulating any fasteners.

In one aspect this invention the balance shoe which is slidably mounted in the channel of a window frame includes a recess in which is rotatably mounted a locking member. The locking member has an exposed keyway. At least one slot is provided at the recess for selective alignment with the keyway. The pivot bar has an arm which functions as a key for fitting in the keyway. The arm also includes a projection extending outwardly from the arm to fit in the slot only when the slot and keyway are aligned.

In a preferred practice of this invention two slots are provided at the recess and two projections, each in the form of a pin, is provided on the arm. The keyway further includes an extension which fits in a channel form in the arm.

In accordance with another aspect of this invention a pivotable window sash assembly includes a channeled window frame which functions as a track for a balance shoe slidably mounted in the channel. A pivot bar is mounted to the window sash and is pivotally engaged with the balance shoe to thereby connect the window sash with the balance shoe for joint movement so that the window sash could be moved up and down and maintained in its proper relationship with the window frame by means of the balance shoe riding in the track provided by the channel. In accordance with the invention the pivot bar is mounted to the window sash by means of a non-movably mounted locking projection on the pivot bar which snaps into a recess in the window sash.

In a preferred practice of this invention the window sash and window frame are extruded so as to have a hollow interior. The recess in the window sash is preferably a hole which extends completely through the sash wall. The locking projection on the pivot bar is preferably in the form of a nub having a cam surface and a locking shoulder.

THE DRAWINGS

DETAILED DESCRIPTION

Figure 1:
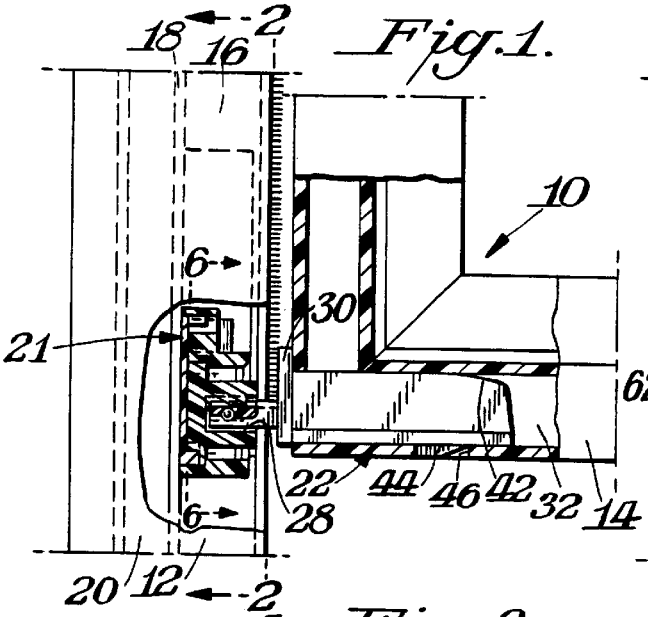
FIG. 1 is a fragmental front elevational view showing a portion of a pivotable window sash assembly in accordance with this invention.
Figure 5:
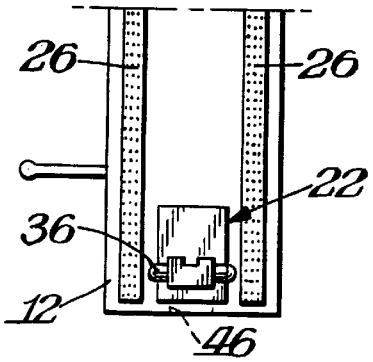
FIG. 5 is a side elevational view showing the pivot bar mounted in the balance shoe.
Figure 6:
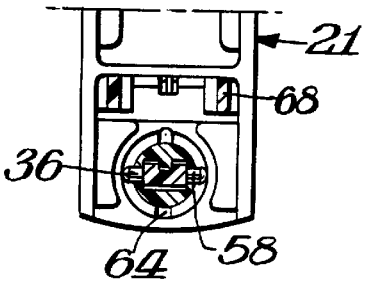
FIG. 6 is a cross-sectional view taken through FIG. 1 along the line 6—6.

FIG. 1 illustrates a portion of a pivotable window sash assembly in accordance with this invention. Most of the components of the assembly 10 may be of known construction wherein, for example, a main frame 12 is provided made of extruded PVC. Frame 12 is, for example, a master frame. The window sash 14 may also be an extruded PVC lift rail. Main frame 12 includes a plurality of channels. One of the channels is channel 16 formed by a pair of flanges 18 which extend over and are parallel to the base wall 20. This channel serves as a track for a modification of a known balance shoe 21. Balance shoe 21 would slide in track 16 under the urging or against the force of, for example, springs 24. Felt strips 26 are mounted to a wall of window sash 12. See FIG. 5

Figure 8:
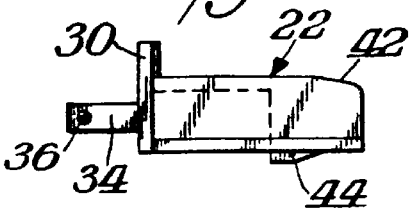
FIG. 8 is a side elevational view of the pivot bar shown in FIGS. 1–7.
Figure 9:
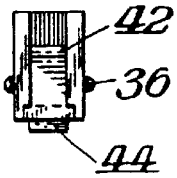
FIG. 9 is an end elevational view of the pivot bar shown in FIG. 8.

Lift rail window sash 14 contains a modification of a known pivot bar 22 which is inserted into the hollow window sash 14 into opening 32. Pivot bar 22 includes an extension 30 peripherally along three sides thereof to act as a stop member and prevent pivot bar 22 from being completely inserted into the hollow opening 32 of sash 14. Extension 30 is clearly shown in FIGS. 8 and 10–11.

Exemplary construction of known pivotable window sash assemblies are found in U.S. Pat. Nos. 4,930,254, 5,069,001 and 5,237,775, the details of which are incorporated herein by reference thereto.

Figure 10:
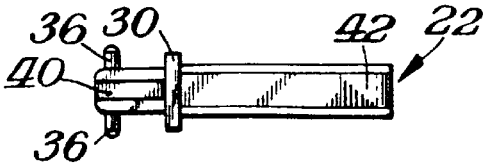
FIG. 10 is a top plan view of the pivot bar shown in FIGS. 8–9.
Figure 7:
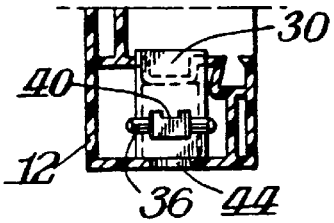
FIG. 7 is a left end elevational view of a portion of the assembly shown in FIGS. 1–6.
Figure 11:
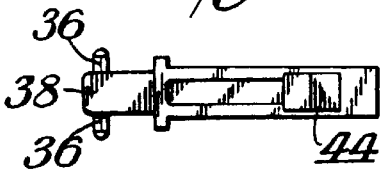
FIG. 11 is a bottom plan view of the pivot bar shown in FIGS. 8–10.

As shown in FIGS. 8–11 pivot bar 22 includes a pair of projections 36,36 in the form of pins which extend inwardly from the outer edge 38 of arm 34. Arm 34 has a channel 40 in its upper surface as shown in FIG. 10 and as also shown in FIG. 7. The opposite end of pivot bar 22 has a downwardly sloping surface 42. The bottom wall of pivot bar 22 includes a locking projection 44 which extends into an opening 46 as shown in FIG. 1 and as described in greater detail with respect to FIGS. 22–29 and in Ser. No. 08/641,433, filed May 1, 1996, the details of which are incorporated herein.

Figure 12:
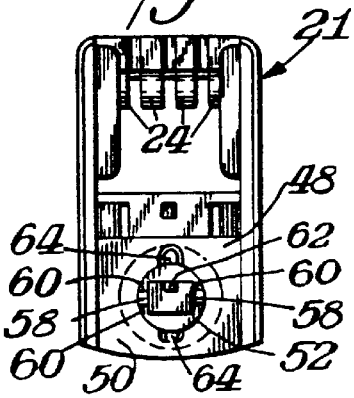
FIG. 12 is a front elevational view of the balance shoe shown in FIGS. 1–7 when the keyway and slots are out of alignment.
Figure 14:
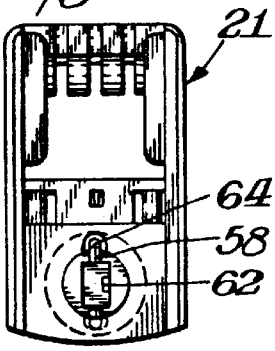
FIG. 14 is a front elevational view of the balance shoe shown in FIGS. 12–13 when the keyway and slots are in alignment.

FIGS. 12–15 show the details of the balance shoe 21. As shown therein balance shoe 21 includes a U-shaped housing 48 having a wall 50 disposed toward pivot bar 22. Wall 50 includes an opening or recess 52 in which is mounted a locking member 54. Locking member 54 is in the form of a disk body having a boss 56 which extends through opening 52 so that the locking member or disk 54 may freely rotate in the housing 48. Boss 56 includes a recess forming a keyway 58 having generally the same shape but slightly larger than pivot bar arm 34. Keyway 58 includes pairs of end shoulders 60 with a single projection 62 formed along one side of and extending into the keyway. A pair of slots 64 are formed in housing wall 50 aligned with each other and communicate with the recess 52. Thus, the keyway 58 may be selectively aligned with the slots 64,64 as shown in FIG. 14 or selectively rotated out of alignment with the slots as shown in FIG. 12.

Figure 3:
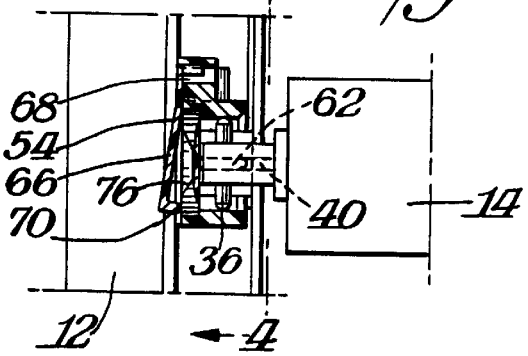
FIG. 3 is a view similar to FIG. 1 showing the position of the window sash assembly structure rotated 90°.

A plate 66 is mounted in the open end of U-shaped housing 48 opposite wall 50. Plate 66 is shown in FIG. 3 to be fixedly mounted or anchored at its end 68. The opposite end 70 of plate 66, however, may move outwardly from housing 48 under the influence of rotating disk 54 as also shown in FIG. 3. End 70 includes a pair of peripheral flanges 72 along each side thereof which fit within the U-shaped housing 48. See FIGS. 13 and 15. A tapered tongue 74 extends from the central portion of plate 66. Tongue 74 may be selectively engaged in a correspondingly shaped notch 76 in locking member or disk 54.

Figure 13:
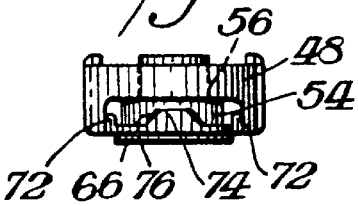
FIG. 13 is a bottom plan view of the balance shoe shown in FIG. 12.
Figure 15:
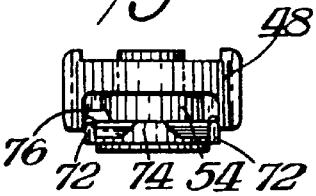
FIG. 15 is a bottom plan view of the balance shoe shown in FIG. 14.

FIGS. 12–13 show the relative position of plate 66 and disk 54 when the keyway 58 is completely out of alignment with slots 64. As shown therein, tongue 72 is engaged in notch 74 to maintain the disk 54 in its non-aligned position. Because of the resilient nature of plate 66 tongue 70 is urged to remain in engagement in notch 74 thus helping to hold the components against any further movement unless a positive force is applied. This condition shown in FIGS. 12 and 13 represents the sash 14 being moved to its closed position for closing the window and thus helping to maintain the window closed.

Figure 4:
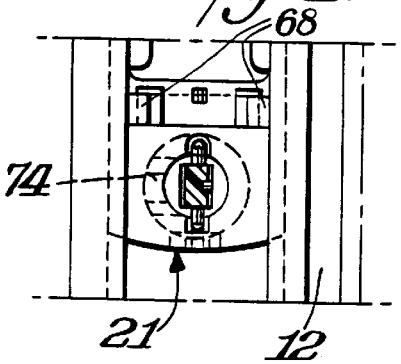
FIG. 4 is a cross-sectional view taken through FIG. 3 along the line 4—4.

In order to assemble the various components pivot bar 22 is installed into opening 32 of sash 14 at, for example, the manufacturing site. Extension 30 limits the degree to which the pivot bar can be inserted into the sash 14. If desired, the utilization of the locking projection 44 may help securely mount the pivot bar to the sash, although such locking projection is not necessary for the practice of this aspect of the invention. Balance shoe 21 is also installed in main frame 12 during initial assembly. Sash 14 is positioned so that the pins 36,36 extending from arm 34 of pivot bar 22 are aligned with slots 64,64 and boss 56 is rotated to align keyway 58 with slots 64,64. Pivot bar 22 is then pushed toward balance shoe 21 to engage arm 34 into the balance shoe 21 and thus lock the pivot bar 22 to the balance shoe 21. This is the condition of balance shoe 21 shown in FIGS. 14–15 as well as, for example, FIGS. 3–4. This would also represent sash 14 being in a window-open condition with respect to main frame 12.

After the window assembly has been mounted in place pivot bar 22 remains engaged with balance shoe 21 thereby permitting sash 14 to be rotated or pivoted from a completely closed condition where the locking components are shown in FIGS. 12 and 13 with tongue 74 engaged in notch 76 to an open position such as shown in FIGS. 3–4 and 14–15. During the rotation of sash 14 from the completely closed position the inclined walls of notch 76 function as a cam with respect to the inclined walls of tongue 74 to overcome the resilient engagement of the tongue in the notch and thus permit the boss 56 to be rotated to a condition where the tongue 74 rests on the upper edge of the boss as shown in FIG. 14 rather than in the notch. During this open condition of sash 14, pins 36,36 are rotated away from slots 64,64 and are disposed under portions of wall 50 to effectively maintain engagement between pivot bar 22 and balance shoe 21.

It is to be understood that the above description and the drawings relate to the preferred practice of the invention. The invention, however, may be practiced in other manners. For example, instead of having pins 36,36 integral with arm 34, arm 34 could have a hole completely therethrough with a shaft or other structural member in the hole and extending outwardly of the hole to perform the function of the pins.

Figure 16:
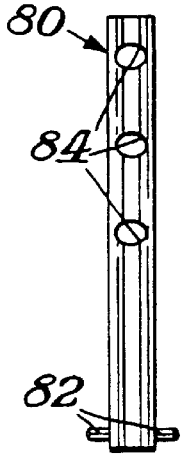
FIG. 16 is a top plan view of a modified form of pivot bar in accordance with this invention.
Figure 17:
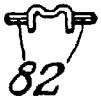
FIG. 17 is an end elevational view of the pivot bar shown in FIG. 16.

FIGS. 16–17 show a modified form of pivot bar 80 which is of much simpler construction than the pivot bar 22 yet would still engage the balance shoe or pivot shoe 21 in the same manner as pivot bar 22. As illustrated, pivot bar 80 is completely of channel shape from end to end dimensioned to fit in the keyway 58 of boss 56 with the legs of the channel disposed on each side of projection 62. As illustrated in FIG. 17 the interconnecting wall of pivot bar 80 is longitudinally indented. The side walls are spaced from and generally parallel to each other. Pivot bar 80 includes a pair of pins 82 similar to pins 36 of pivot bar 22. Pins 82 would fit in slots 64 when locking member or disk 54 is rotated in the previously described manner.

Pivot bar 80 may be of any suitable length in accordance with the intended window structure. For example, pivot bar 80 may have a length of 2½ inches or 2⅝ inches or 3 inches. A plurality of holes or openings 84 could be formed in the interconnecting wall of pivot bar 80 to accommodate screws or other fasteners for securing the pivot bar to a sash. FIG. 16 illustrates three such holes 84 each of which is generally oval or could be circular in shape. Other variations could include a single hole which may be circular in shape, generally centrally placed or located more toward the portion of pivot bar 80 remote from pins 82. Alternatively, a pair of elongated slots could be formed in the interconnecting wall of pivot bar 80 with each slot extending on opposite sides of the interconnecting wall.

In addition, although in the preferred practice a pair of aligned slots are provided for selective alignment with the keyway, other arrangements may be used. Thus the invention may be practiced with only one slot or with more complicated aligning structure, such as a keyway having an additional diverging recess for alignment for yet still another slot. similarly, while the invention is preferably practiced by utilizing pins for engagement in the slots, other types of projections or structure may be used. The intent is to provide complementary projections which fit in complementary openings with respect to the pivot bar and balance shoe.

Figure 18:
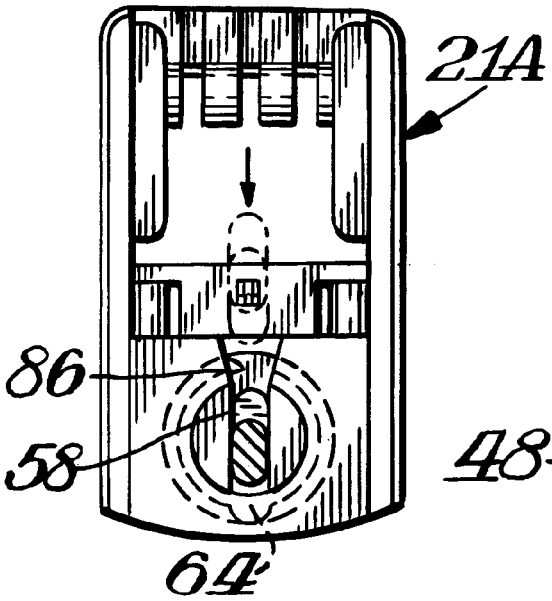
FIG. 18 is a front elevational view showing a modified form of balance shoe in accordance with this invention.
Figure 20:
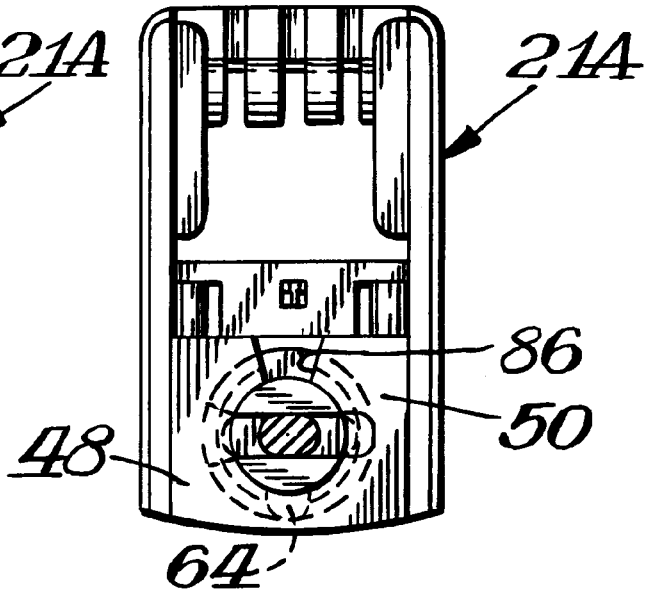
FIG. 20 is a view similar to FIG. 18 in a different mode of operation.
Figure 19:
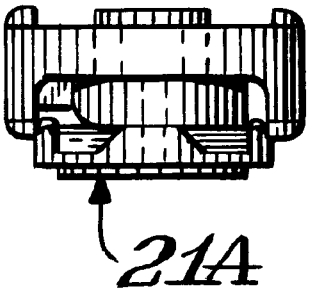
FIG. 19 is a bottom plan view of the balance shoe shown in FIG. 18.
Figure 21:
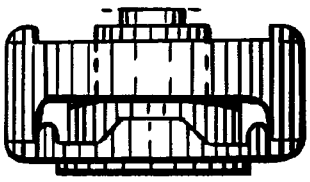
FIG. 21 is a bottom plan view of the balance shoe shown in FIG. 20.

FIGS. 18–21 illustrate an alternative form of balance shoe 21A. As shown therein, instead of having a pair of slots formed in the housing 48 a single slot 64 is provided which extends from the outer surface of housing 48 inwardly. The slot 64 cooperates with a passageway 86 cut into housing 48 in communication with recess 52 of wall 50 of housing 48. Passageway 86 communicates with the open space above wall 50 thus forming a drop in chute for the pivot bar. If desired the walls of chute or passageway 86 may be tapered as illustrated to facilitate the pivot bar pins 36,82 entering the chute 86 for engagement with the aligned keyway 58. FIGS. 18–19 show the keyway aligned with slot 64 and chute 86 while FIGS. 20–21 show the keyway 58 rotated out of alignment.

Where a drop in chute is used such as chute 86 it is not necessary to have a slot in addition to the chute since the invention may be practiced with a pivot bar having only one projection which is accommodated by the chute. It is preferred, however, to give greater assurance in operation to have either a pair of slots or a slot and a chute.

FIGS. 7–11 illustrate the pivot bar 22 to include a locking member 44. The purpose of that locking member is best understood from FIGS. 22–29 with regard to the locking member 136.

Figure 2:
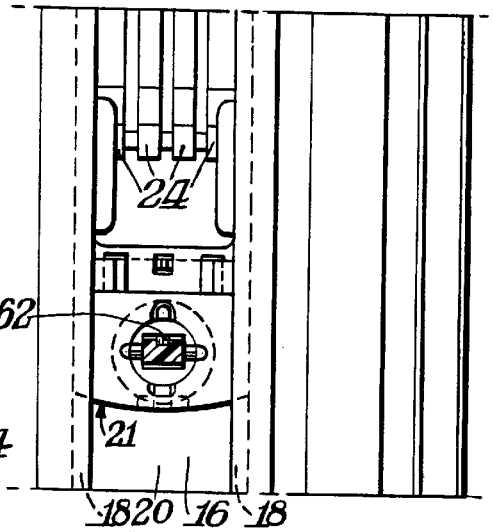
FIG. 2 is a cross-sectional view taken through FIG. 1 along the line 2—2.
Figure 22:
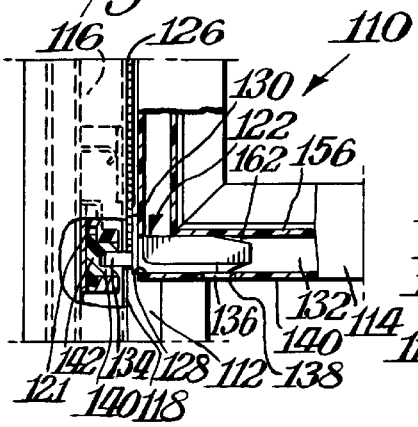
FIG. 22 is a fragmental front elevational view showing a portion of a pivotable window sash assembly in accordance with another aspect of this invention.
Figure 23:
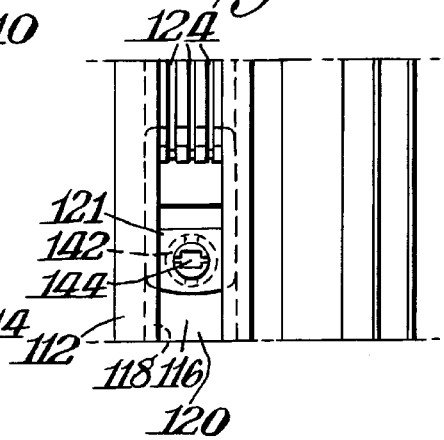
FIG. 23 is a fragmental end elevational view of a portion of the assembly shown in FIG. 22 with the balance shoe shown in the main frame track.
Figure 24:
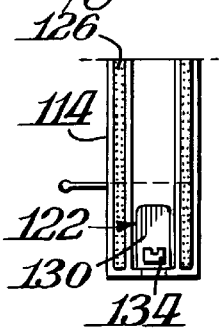
FIG. 24 is a fragmental end elevational view of a portion of the assembly shown in FIGS. 22–23 with the pivot bar mounted in the window frame.
Figure 28:
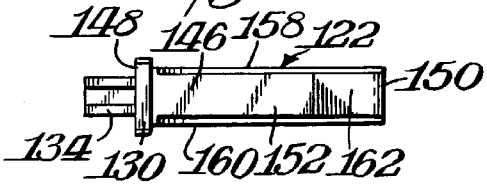
FIG. 28 is a top plan view of the pivot bar shown in FIGS. 26–27.
Figure 25:
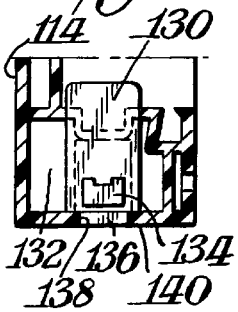
FIG. 25 is a left end elevational view of a portion of the assembly shown in FIGS. 22–24 with the pivot bar and window sash shown in cross-section.
Figure 26:
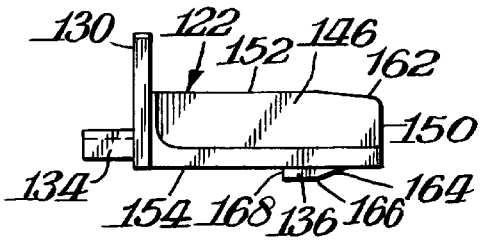
FIG. 26 is a side elevational view of the pivot bar shown in FIGS. 22–25.
Figure 27:
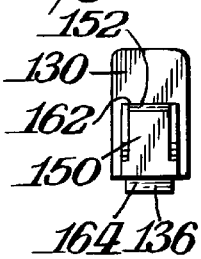
FIG. 27 is a right end elevational view of the pivot bar shown in FIG. 25.
Figure 29:
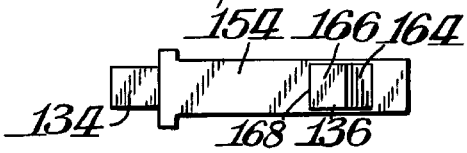
FIG. 29 is a bottom plan view of the pivot bar shown in FIGS. 26–28.

FIG. 22 illustrates a portion of a pivotable window sash assembly 110 in accordance with another aspect of this invention. Most of the components of the assembly 110 may be of known construction wherein, for example, a main frame 112 is provided made of extruded PVC. Frame 112 is, for example, a master frame. The window sash 114 may also be an extruded PVC lift rail. Main frame 112 includes a plurality of channels, one of which is channel 116 formed by a pair of flanges 118 which extend over and are generally parallel to a base wall 120. This channel 116 serves as a track for a known balance shoe 121. Balance shoe 121 would slide in track 116 under the urging of or against the force of, for example, springs 124 as best shown in FIG. 2. Felt strips 126 are mounted to a wall of window sash 114.

Lift rail window sash 114 contains a known pivot bar 122 which is inserted through an opening 128 in the hollow window sash 114. Pivot bar 122 includes an extension 130 peripherally along three sides thereof to act as a stop member and prevent pivot bar 122 from being completely inserted into the hollow opening 132 of sash 114. Extension 130 is clearly shown in FIGS. 25–29.

A pivot arm or connecting arm 134 extends outwardly from extension 130 and is received in balance shoe 121 as later described. Pivot bar 122 is secured to sash 114 by means of a locking projection 136 which is received in a recess 138, preferably in the form of a hole extending completely through the outer wall 140 of sash 114 as shown in FIG. 22. Locking projection 136 is similar to locking projection 44 of pivot bar 22 illustrated in FIGS. 7–11.

Balance shoe 121 contains a freely mounted sleeve 142 having an irregularly shaped slot 144 for receiving the correspondingly shaped arm 134 of pivot bar 122. The mounting of arm 134 in sleeve 142 results in a coupling together of the sash 114 and balance shoe 121 so that there is joint movement in an up and down direction with respect to the sash 114 and balance shoe 121. The coupling, however, also permits pivotal movement between the sash 114 and balance shoe 121 and thus pivotal movement between the sash 114 and frame 112. This pivotal movement results from the ability of sleeve 142 to rotate within balance shoe 121. Sleeve 142 may include a notch (not shown) which is selectively engaged by a projection on a movable tongue (not shown) in balance shoe 121 to selectively lock the sleeve and thus prevent any pivotal movement.

Because of the pivotal movement it is possible to tilt the window sash outwardly thereby placing the window sash in a condition where, for example, the window may be conveniently cleaned.

FIGS. 25–29 show the details of pivot bar 122. As shown therein, pivot bar 122 includes a body portion 146 in the form of a block having a side 148 which would be disposed toward the balance shoe and thus may be considered a shoe side. Extension 130 is connected to shoe side 148. The opposite end of block 122 has a distal side 150. The sides 148 and 150 are connected by a first sash side 152 and a second sash side 154 generally parallel to each other and perpendicular to the end walls 148 and 150. The sides 152 and 154 are dimensioned so as to be slightly smaller than the spacing between walls 140 and 156 of sash 114. The side walls 158,160 of block 146 are generally parallel to each other.

The first sash side 152 has a downwardly sloping surface 162 which functions as a camming surface to facilitate the insertion of pivot bar 122 into hollow opening 132 of sash 114. The second sash side 154 includes the mounting lock member 136. Lock member 136 also has a ramp or inclined side 164 which merges with a flat side 166 and terminates in a perpendicular stop shoulder 168. The structure facilitates lock member 136 being snapped into hole 138 in wall 140 of sash 114 with the stop shoulder 168 disposed against the edge of hole 138 to prevent any tendency of the pivot bar 122 from being removed from lift rail or sash 114. The snapping action of the lock member 136 in the hole 138 results from the hollow sash being deflectable thus permitting the sash to deflect outwardly under the force of the inserted pivot bar 122 until lock member 136 enters hole 138 whereupon the sash would be in its position shown in FIG. 22. As also shown in FIG. 22, in this locking position there is at least three areas of surface-to-surface contact between the pivot bar 122 and the sash. Specifically, there is surface contact on both the shoe side and the distal side of lock member 136 as well as on the sash side opposite and between those two locations.

Lift bar 122 may be made of any suitable material and preferably is made of a metal such as zamac-3.

In practice opposite sides of the sash 114 would include a separate pivot bar which in turn would be mounted in a respective balance shoe on opposite sides of the master frame 112.

What is claimed is:

1. In a pivotable window sash assembly mounting a tilt window sash to a channeled window frame, said frame having an elongated channel functioning as a track, a balance shoe slidably mounted in said channel for movement therein, a pivot bar mounted to said window sash, and said pivot bar being pivotally engaged with said balance shoe and connecting said window sash with said balance shoe for joint movement of said window sash and said balance shoe and for selective pivotal movement of said window sash with respect to said balance shoe and said window frame, the improvement being in that said window sash is made from an extruded plastic material and contains a vertical passageway communicating with a horizontal passageway with a common junction area, said horizontal passageway having an inner horizontal wall spaced from an outer horizontal wall, said outer horizontal wall being a deflectable wall, a recess in said deflectable outer horizontal wall, said pivot bar comprising a body portion having a shoe side and a distal side remote from said shoe side, said body portion further having a first sash side interconnecting said shoe side and said distal side, a second sash side remote from and generally parallel to said first sash side, said pivot bar having a rigid non-deflectable non-movably mounted locking projection extending from said second sash side for deflecting said recess wall and snapping into said recess, said projection being spaced inwardly of said distal side, and said pivot bar being lockably mounted to said window sash when said projection is in said recess without requiring the manipulation of any fasteners for the mounting of said pivot bar to said window sash other than a sliding movement of said pivot bar.

2. The assembly of claim 1 wherein said locking projection having an inclined ramp to function as a cam surface at a lead edge to facilitate said pivot bar entering and moving through said horizontal passageway, said locking projection having a stop shoulder remote from said cam surface for minimizing any tendency of said projection from being removed from said recess.

3. The assembly of claim 2 wherein said distal side of said body portion is generally parallel to said shoe side of said body portion, said first sash side being generally perpendicular to said shoe side and said distal side of said body portion, said inner horizontal wall and said outer horizontal wall being parallel to each other to create a uniform spacing therebetween, said first sash side and said second sash side being spaced apart by a distance generally equal to said uniform spacing whereby said body portion snugly fits in said spacing, the distance between said second sash side and the outer edge of said locking projection remote from said second sash side being greater than said uniform spacing, said second sash side being in surface contact with said sash at a first. location between said shoe side and said projection and at a second location between said distal side and said projection, said first sash side being in surface contact with said sash at a third location across from and between said first location and said second location, and said pivot bar substantially filling said horizontal passageway where said pivot bar is located in said horizontal passageway.

4. The assembly of claim 3 wherein said vertical passageway having an inner vertical wall joined to an inner horizontal wall of said horizontal passageway, said vertical passageway having an outer vertical wall in line with an outer edge of an outer horizontal wall of said horizontal passageway, an opening in said outer vertical wall above said outer edge of said outer horizontal wall.

5. The assembly of claim 4 wherein a stop extension extending generally outwardly of said body portion at said shoe side and in a direction away from and remote from said second sash side, a pivot arm rigidly and non-movably mounted to and extending outwardly from said body member at said shoe side, said pivot arm extending through said opening in said outer vertical wall, said stop extension being disposed outwardly of and against said outer vertical wall.

6. The assembly of claim 2 wherein said locking projection shoulder is perpendicular to said second sash side for engagement against the wall of the recess remote from said ramp.

7. The assembly of claim 1 wherein said window sash is an extruded lift rail having a hollow interior, and said recess being a hole extending completely through a wall of said lift rail to said hollow interior.

8. The assembly of claim 7 wherein said balance shoe includes a pocket having a rotatably mounted sleeve, a slot being in said sleeve, and said arm being mounted in said slot.

9. The assembly of claim 8 wherein said frame is an extruded master frame having a pair of aligned flanges which confine said balance shoe to said master frame, and said pivot bar arm extending between said flanges into said sleeve.

10. The assembly of claim 9 wherein said master frame includes two spaced channeled walls with one of said balance shoes being in each of said walls, said window sash including two spaced parallel walls each of which is disposed toward a respective one of said window frame walls, and one of said pivot bars being in each of said window sash walls.

11. The assembly of claim 9 wherein said pivot bar is made of a metal material, and said window sash and said window frame are made of an extruded plastic material.

12. A pivot bar for attaching a window sash to a balance shoe which is slidably mounted in a channel of a window frame, said pivot bar comprising a body portion in the form of a block having a shoe side and a distal side remote from and generally parallel to said shoe side, said block further having a first sash side interconnecting and generally perpendicular to said shoe side and said distal side, a second sash side remote from and generally parallel to said first sash side, a pivot arm rigidly and non-deflectably and non-movably mounted to and extending outwardly from said shoe side for insertion into a balance shoe, a mounting lock member rigidly and non-movably mounted to and outwardly from said second sash side inwardly of said distal side for engagement in a recess in the sash by sliding said pivot bar until said lock member reaches a wall defining the recess to deflect the wall until said lock member is inserted into the recess, and said lock member having a shoulder to define a lock wall located toward said shoe side and remote from said distal side.

13. The pivot bar of claim 12 wherein said first sash side being tapered toward said second sash side at said distal side to comprise a cam edge for facilitating the insertion of said pivot bar into a hollow interior of an extruded sash.

14. The pivot bar of claim 12 wherein said lock member having an inclined ramp to function as a cam surface for facilitating sliding movement of said pivot bar, and said shoulder of said lock member being remote from said cam surface and perpendicular to said second sash side.

15. The pivot bar of claim 14 wherein said second sash side having a first surface at a location between said lock member and said shoe side for making surface contact with the sash, said second sash side having a second surface in line with said first surface at a location between said lock member and said distal side for making surface contact with the sash, and said first sash side having a surface across from and parallel to and between said first surface and said second surface of said second sash side for making surface contact with the sash.

16. The pivot bar of claim 14 wherein said ramp converges toward said cam surface.

17. The pivot bar of claim 16 including a stop extension outwardly of said block to prevent said pivot bar from being inserted completely into the window sash.

18. The pivot bar of claim 17 wherein said pivot bar is made of a metal material.

* * * * *